US005903107A

United States Patent [19]

Wade

[11] Patent Number: 5,903,107

[45] Date of Patent: May 11, 1999

[54] LIGHTED SWITCH APPARATUS

[76] Inventor: William G. Wade, 2692 Town Farm Rd., Unity, Me. 04988

[21] Appl. No.: 08/774,335

[22] Filed: Dec. 30, 1996

[51] Int. Cl.[6] ..... H01H 9/16

[52] U.S. Cl. ..... 315/129; 315/76; 315/205; 200/310; 200/314; 200/315; 362/802; 340/641

[58] Field of Search ..... 200/314, 315, 200/316, 60, 310; 315/72, 74, 272, 129, 71, 76, 205, DIG. 4; 362/23, 24, 29, 802; 340/641, 642, 644

[56] References Cited

U.S. PATENT DOCUMENTS

| | | | |
|---|---|---|---|
| 3,058,032 | 10/1962 | Woodward | 315/72 |
| 3,113,197 | 12/1963 | Green . | |
| 3,168,636 | 2/1965 | De Smidt . | |
| 3,174,023 | 3/1965 | Doggart . | |
| 3,179,777 | 4/1965 | Rohacs . | |
| 3,215,806 | 11/1965 | Arnold et al. . | |
| 3,267,926 | 8/1966 | Prince . | |
| 3,317,696 | 5/1967 | Sanchez . | |
| 3,409,751 | 11/1968 | Krieger . | |
| 3,466,408 | 9/1969 | Basso . | |
| 3,555,420 | 1/1971 | Schwartz | 324/72.5 |
| 3,636,515 | 1/1972 | Smith . | |
| 3,838,339 | 9/1974 | Brandt | 324/133 |
| 4,135,073 | 1/1979 | Kobayashi | 200/315 |
| 4,431,880 | 2/1984 | Ives | 200/315 |
| 4,758,724 | 7/1988 | Osika | 200/315 |
| 5,361,017 | 11/1994 | Krause | 315/151 |
| 5,453,731 | 9/1995 | Beyer | 340/438 |

*Primary Examiner*—Arnold Kinkead
*Attorney, Agent, or Firm*—Choate, Hall & Stewart

[57] ABSTRACT

A display apparatus for illuminating a switch is provided which includes a switch having an on and off position to control power from a power supply to a device. A light source is located near the switch to illuminate the switch. A diode is electrically connected between the on position of the switch and the light source. A first resistor is electrically connected between the off position of the switch and the light source. The first resistor is electrically in parallel with the switch and the diode. When the switch is in the off position, power is provided to the light source via the first resistor whereby the light source illuminates at a first brightness. When the switch is in the on position, power is provided to the light source via the diode whereby the light source illuminates at a second brightness which is greater than the first brightness. Thus, the light source is always illuminated to facilitate locating the switch, and the light source illuminates brightly when the switch is on so that a person can quickly determine whether the switch is in the on or off position.

8 Claims, 1 Drawing Sheet

LIGHTED SWITCH APPARATUS

BACKGROUND OF THE INVENTION

This invention relates generally to electrical switches and, more specifically, to locating and indicating the on/off status of an electrical switch.

When operating electrical equipment it is advantageous to have an indicator which shows whether an electrical circuit or device within the equipment is on or off. Many electrical circuits are turned on and off with a manually operated switch. At a basic level, a lever or button on the switch indicates the on/off status of the electrical equipment. The position of a toggle switch, for example, is readily identifiable because the toggle handle is large. The positions of rocker and push button switches, however, are more difficult to distinguish especially in low light situations.

Most switch indicator designs employ a light source that illuminates the switch only when the switch is turned on. Other indicator designs use a separate display light which is energized from a separate power supply. There are indicators that use multiple bulbs or light sources to indicate one of several switch control positions.

In addition to indicating the on/off status of an electrical device, it would also be advantageous to use a light source to aid in locating the switch. Numerous indicator designs illuminate switches internally or employ lighted labels near the switch. These indicators are generally constantly illuminated, obtaining power from a separate lighting circuit.

It is an object of the present invention to provide a continuously illuminated display apparatus for indicating the on/off status of a switch.

It is another object of the present invention to provide a display apparatus with at least two brightness levels to indicate the on/off status of a switch in an electrical circuit.

It is yet another object of the present invention to provide a display apparatus for indicating the on/off status of a switch that utilizes the same power supply as that which the switch controls.

It is still another object of the present invention to provide a display apparatus that indicates the on/off status of a switch that is simple, inexpensive, and lightweight.

SUMMARY OF THE INVENTION

These objects are attained by providing a display apparatus for lighting a switch which controls power to a device and includes a power supply and a light source located proximate to the switch. The light source is in electrical communication with the power supply. The switch is electrically connected between the power supply and the device and has an on and off position for controlling power to the device. A diode is electrically connected between a device side of the switch and the light source. Also included in the display apparatus is a first resistor electrically connected between the power supply and the light source, and electrically in parallel with the switch and the diode. When the switch is in the off position, the switch directs power to the light source via the first resistor such that the light source illuminates at a first brightness. In the on position, the switch directs power to the light source via the diode such that the light source illuminates at a second brightness which is greater than the first brightness.

The display apparatus of the present invention indicates both the status and the location of the associated switch. When the switch is off, the light source is constantly illuminated at a fixed background level. When the switch is on, the light source illuminates more brightly to indicate that the switch is on. This has the further advantage of indicating the location of the switch in any ambient light condition and demonstrating that there is power at the switch. The light source and its circuit components may be mounted within a switch housing or mounted proximate to the switch in a separate display apparatus housing.

Another aspect of the display apparatus further includes a second resistor electrically connected between the light source and a return line of the power supply for further regulating the voltage drop across the light source. The first resistor is at least as resistive as the second resistor such that the second brightness is readily discernable from the first brightness.

DETAILED DESCRIPTION OF PREFERRED EMBODIMENTS

Figure 1:
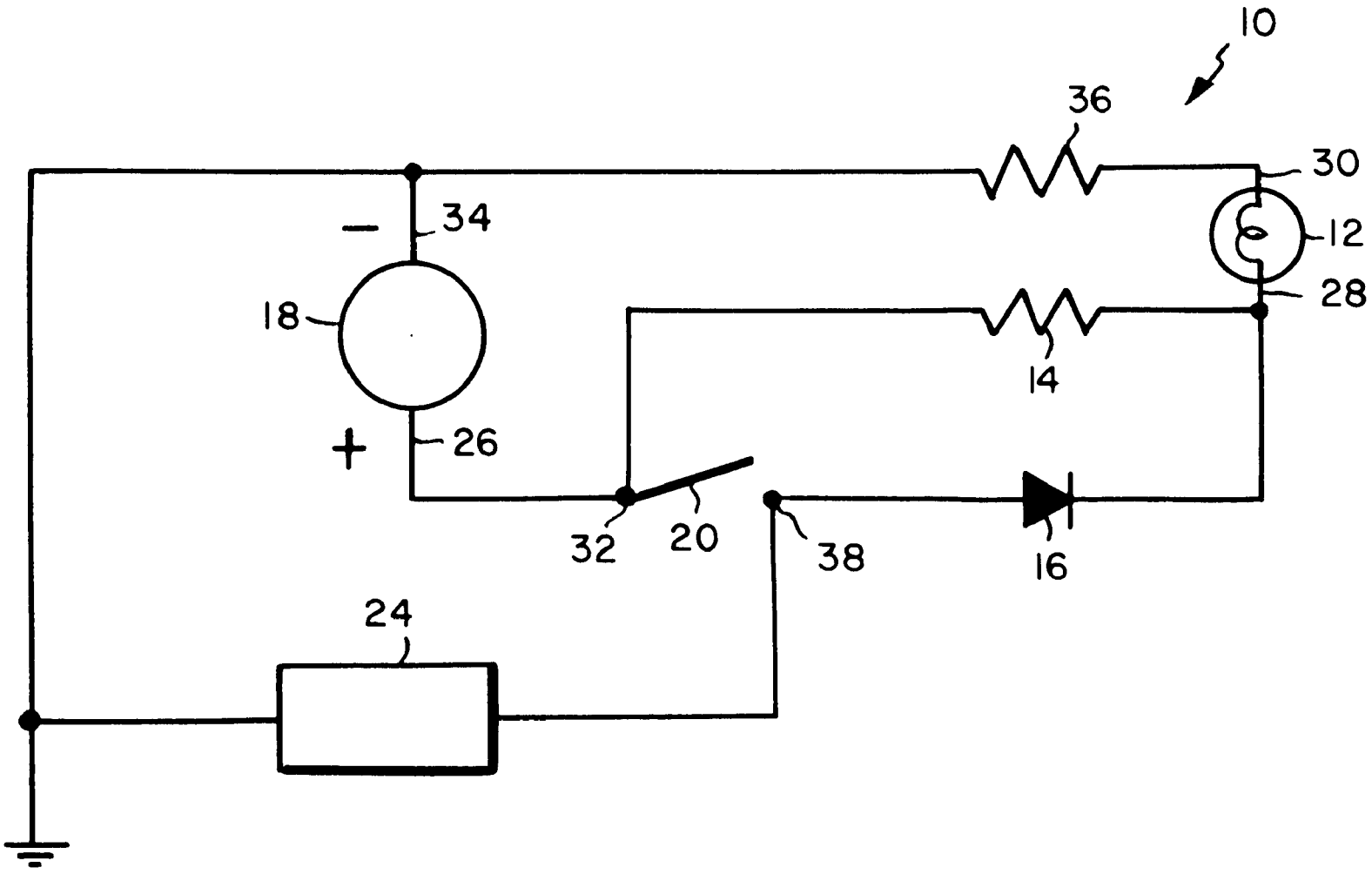
FIG. 1 is a schematic diagram according to the present invention.

In FIG. 1, the display apparatus of the present invention is indicated generally by reference numeral 10. The display apparatus 10 includes a light source 12, a first resistor 14, and a diode 16. The circuit containing the display apparatus 10 includes a power supply 18. The power supply 18 can be any standard power supply such as a battery or an AC/DC transformer. In the illustrated embodiment, the power supply 18 is a direct current source having a voltage of fourteen volts.

A switch 20 controls the delivery of power from the power supply 18 to a device 24. The device 24 can be any electrically powered component such as a mechanism which lowers an airplane's landing gear. The switch 20 is electrically connected between a positive side 26 of power supply 18 and device 24. Switch 20 has an on and an off position, with the on position corresponding to power being supplied to device 24. In the off position, switch 20 prevents power from power supply 18 from reaching device 24.

The light source 12 is preferably located near switch 20 such that a person looking at light source 12 can readily associate its illumination with the status of switch 20. Furthermore, light source 12 can be a color, such as red, to more clearly indicate a device 24 whose status is critical. Any typical light source 12 can be used including a typical light bulb or an LED. One such typical light bulb is a #382 bulb (available from SPC Technology, General Electric, or other electrical part manufacturers). Light source 12 has two leads 28, 30 with lead 28 electrically connected to the first resistor 14. The first resistor 14 is electrically connected to the positive side 26 of power supply 18 which is also a power side 32 of switch 20. The other lead 30 of light source 12 is connected to a return 34 of power supply 18 through a second resistor 36. Thus, the light source 12 is always connected to power supply 18 and light source 12 is always illuminated when switch 20 is off.

The diode 16 is electrically connected between a device side 38 of switch 20 and lead 28 of light source 12. A suitable diode 16 (such as a 1N4001 diode) is available from most electronic parts distributors. Together, the diode 16 and switch 20 are electrically connected in parallel with first resistor 14. The polarity of diode 16 allows current to flow through switch 20 (in the on position) to light source 12, and prevents current from flowing from first resistor 14 to device 24 (when switch 20 is in the on position).

Therefore, when switch 20 is in the off position, current does not flow to the device 24, but instead flows from power supply 18, through first resistor 14, and to light source 12. In the on position, current from power supply 18 flows, through switch 20, to device 24. The current from power supply 18 also flows through diode 16 and to light source 12. With switch 20 in the on position, most current will avoid first resistor 14 and flow directly to light source 12 causing light source 12 to illuminate more brightly when switch 20 is in the on position than when it is in the off position.

The first and second resistors 14, 36 can be chosen such that light source 12 will illuminate dimly when switch 20 is off and brightly when switch 20 is on. In the display apparatus 10 illustrated in FIG. 1, first resistor 14 has a resistance of about sixty-eight ohms and second resistor 36 has a resistance of about thirty-three ohms. With these resistance values, together with a 14 volt direct current power supply 24 and a #382 bulb light source 12, the light source 12 will illuminate significantly brighter when switch 20 is on, as compared to when switch 20 is off. Thus, a person looking at light source 12 can readily and easily tell whether switch 20 is on or off. Furthermore, because light source 12 is always illuminated, even when switch 20 is off, a person can readily locate the switch in low-light conditions or amongst many other switches.

The display apparatus 10 can be mounted within a switch housing or mounted proximate to switch 20 in a separate display apparatus housing (not shown). The display apparatus 10 need only be close enough to switch 20 so that a person can readily perceive that light source 12 corresponds with switch 20.

While there have been described herein what are considered to be preferred embodiments of the present invention, other modifications of the invention will be apparent to those skilled in the art from the teaching herein. Thus, for instance, whereas the examples above primarily concerned direct current, it will be appreciated that the invention is equally applicable with alternating current. It is therefore desired to be secured in the appended claims all such modifications as fall within the true spirit and scope of the invention. Accordingly, what is desired to be secured by Letters Patent of the United States is the invention as defined and differentiated in the following claims.

I claim:

1. A display apparatus for illuminating a switch which controls power from a power supply to a device comprising:

a light source located proximate to the switch;

the switch being electrically connected between the power supply and the device, and the switch having an on and off position for controlling the power from the power supply to the device;

a diode electrically connected between a device side of the switch and the light source; and a first resistor electrically connected between a power supply side of the switch and the light source, whereby in the off position, the switch directs power to the light source via the first resistor such that the light source illuminates at a first constant brightness, and, in the on position, the first resistor is electrically connected in parallel with the diode and the switch directs power to the light source via the diode such that the light source illuminates at a second constant brightness which is greater than the first brightness.

2. The display apparatus of claim 1 further including a second resistor electrically connected between the light source and a return line of the power supply for further regulating the first and second brightnesses of the light source.

3. The display apparatus of claim 2 wherein the first resistor is at least as resistive as the second resistor.

4. The display apparatus of claim 2 wherein the first resistor is at least twice as resistive as the second resistor.

5. The display apparatus of claim 4 wherein the light source is a light emitting diode.

6. The display apparatus of claim 1 further including a second resistor electrically connected to the light source for further regulating the first and second brightness of the light source.

7. The display apparatus of claim 4 wherein the light source is a light bulb.

8. A display apparatus for indicating an on and off status of a device comprising:

a power supply;

a switch connected between the power supply and the device, the switch having an on and off position for controlling the power from the power supply to the device;

a light source located proximate to the switch;

a first resistor electrically connected between a power supply side of the switch and the light source; and a diode electrically connected between a device side of the switch and the light source and orientated to prevent power from passing to the device via the first resistor;

whereby in the off position, the switch directs power to the light source via the first resistor such that the light source illuminates at a first brightness, and in the on position, the switch directs power to the light source via the diode such that the light source illuminates at a second brightness which is greater than the first brightness.

* * * * *